United States Patent [19]

Pranch

[11] Patent Number: 4,687,273

[45] Date of Patent: Aug. 18, 1987

[54] CONNECTOR FOR ELECTRICAL CONDUCTORS

[75] Inventor: Anatoly S. Pranch, Riga, U.S.S.R.

[73] Assignee: Latviisky Gosudarstvenny Universitet Imeni Petra Stuchki, Riga, U.S.S.R.

[21] Appl. No.: 727,774

[22] Filed: Apr. 26, 1985

[51] Int. Cl.[4] ..... H01R 11/26

[52] U.S. Cl. ..... 439/411; 439/417; 439/780; 439/791; 439/801

[58] Field of Search ..... 339/95 R, 249 A, 263 R; 174/85 C

[56] References Cited

U.S. PATENT DOCUMENTS

| | | | |
|---|---|---|---|
| 2,825,041 | 2/1958 | Meyer | 339/263 R |
| 4,112,251 | 9/1978 | Scott | 174/87 |

FOREIGN PATENT DOCUMENTS

| | | | |
|---|---|---|---|
| 49-14995 | 4/1974 | Japan . | |
| 38420 | 10/1978 | Japan | 339/278 C |
| 458749 | 12/1936 | United Kingdom | 339/95 R |

OTHER PUBLICATIONS

IBM Bulletin; Self Locking Terminal; Panaro, vol. 3, No. 6, Nov. 1960.

*Primary Examiner*—Gil Weidenfeld
*Assistant Examiner*—Paula A. Austin
*Attorney, Agent, or Firm*—Fleit, Jacobson, Cohn & Price

[57] ABSTRACT

A connector comprises a sleeve and a rod, the threaded interfacing surface of one of the parts being provided with a longitudinal recess for the input of conductors. The recess has a concave surface facing the longitudinal axis of the connector and the depth thereof increases in the direction where the two parts are joined.

1 Claim, 4 Drawing Figures

CONNECTOR FOR ELECTRICAL CONDUCTORS

FIELD OF THE INVENTION

The invention relates to electrical engineering generally and, more particularly, to connectors for electric conductors.

The invention can be used to the best advantage, for example, in connecting mechanically unloaded conductors in the distribution boxes of power systems, in wiring power and radio circuits, etc.

Furthermore, the invention is usable to connect mechanically loaded conductors in power and communications lines.

This invention also forms the subject matter of prior application No. 3663942, filed in the U.S.S.R. on Nov. 21, 1983 and granted Inventor's Certificate No. 1270818 on Nov. 15, 1986, prior application No. P34 46 487, filed in the Federal Republic of Germany on Dec. 21, 1984, and prior application No. 5818/84, filed in Denmark on Dec. 6, 1984.

There is known in the art a connector for electric conductors, comprising two parts—a sleeve and a rod—having a threaded surface. The threaded interface surface of one of the parts has a longitudinal recess adapted to receive a conductor, said recess extending at a sharp angle with the connector centerline (Japanese Application No. 49-14995, Int.cl. HOlR 9/08).

The old connector is characterized by high electric resistance on account of its limited actual contact area with conductors to be jointed.

It is the object of this invention to provide a connector having a recess adapted to receive a conductor arranged so as to increase the contact area of the conductor with electric conductors, thereby lowering electrical resistance and enhancing connector dependability.

It is an object of this invention to provide a connector which could increase the contact area with electrical conductors.

One more object of the invention is to reduce the electrical resistance and improve the reliability of the connection.

SUMMARY OF THE INVENTION

This object is achieved by providing a connector for electric conductors, comprising two parts—a threaded sleeve and rod—the threaded interface surface of one of said parts having a recess adapted to receive a conductor extending at a sharp angle with the connector centerline, and further, according to the invention, having the said recess arranged in the portion of the threaded surface on the side of the joint and having a concave surface facing the connector centerline and increasing in depth in the direction of connection of the connector parts.

A recess arranged to receive a conductor as described above allows conductors to be arrangd therein, whereof the ends of wire are bent in a dog-tooth pattern; this permits the contact area of the connector with conductors to increase proportionately to the number of bends in the conductor, thereby reducing the electrical resistance of the joint. The shear cold welding effect occurring at the time of threading together the parts of the connector in its contact area with a bent conductor secures a more dependable joint than is possible with existing techniques, the welding effect being present over a larger combined area and with less deformation that is the case with straight conductors, thereby improving the resistance of the joint to external mechanical and chemical action capable of disturbing the contact.

BRIEF DESCRIPTION OF THE ACCOMPANYING DRAWINGS

The invention will be better understood from the following detailed description of its particular embodiment and by reference to the accompanying drawings, of which:

DETAILED DESCRIPTION OF THE INVENTION

Figure 1:
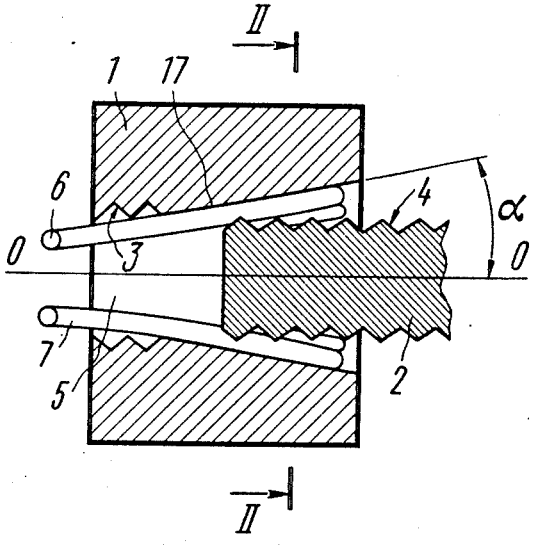
FIG. 1 is a longitudinally cutaway general view of a connector of the invention for electric conductors, having a sleeve with two recesses adapted to receive conductors.

The proposed connector for electric conductors comprises two parts—sleeve 1 (FIG. 1) and rod 2. The sleeve 1 and the rod 2 are joined together by threaded surfaces 3 and 4, respectively. The rod 2 is a clearance fit in opening 5 of the sleeve 1, the width of the gap being smaller than the diameter of conductors 6 and 7 to be jointed. Threaded interface surface 3 of the sleeve 1 has two longitudinally tapered recesses 8 (FIG. 2) adapted to receive the conductors 6 and 7 and extending at a sharp acute angle $\alpha$ (FIG. 1) with the connector centerline O—O. As is clearly shown in FIG. 1, each recess 8 opens into the interior of the sleeve along the entire length of the recess.

Figure 3:
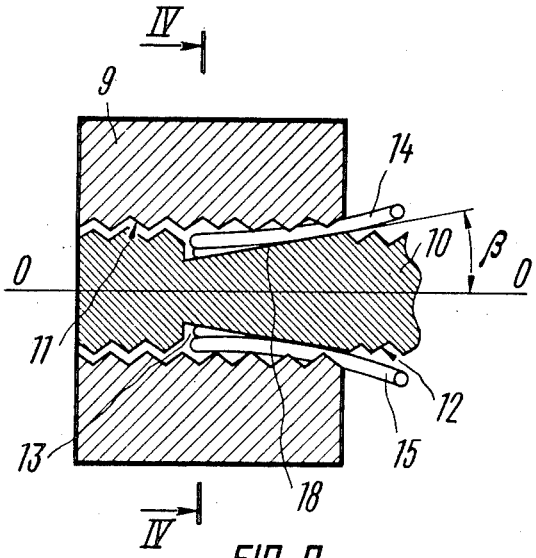
FIG. 3 is a longitudinally cutaway general view of a connector of the invention having a rod with two recesses adapted to receive conductors.

FIG. 3 shows an alternate connector design comprising sleeve 9 and rod 10 having threaded surfaces 11 and 12, respectively. The rod 10 is a clearance fit in opening 13 in the sleeve 9, the width of the gap being smaller than the diameter of conductors 14 and 15 to be jointed. The threaded interface surface 12 of the rod 10 has two longitudinal recesses 16 (FIG. 14) adapted to receive the conductors 14 and 15 and extending at a sharp angle $\alpha$ (FIG. 3) with the connector centerline O—O. As is clearly shown in FIG. 3, each recess 16 opens outward with respect to the rod along the entire length of the recess.

The number of recesses is the function of various factors such as the arrangement of the conductors to be jointed in the circuit, their dimensional specifications (diameter length), etc.

According to the invention the recesses 8 and 16 are provided in portions 17 and 18, respectively, of the threaded surfaces 3 and 12, respectively, of the sleeve 1 or of the rod 10 on the side of the joint. The surfaces of the recesses 8 and 16 are concave and facing the connector centerline O—O. The recesses 8 and 16 increase in depth in the direction of the connection of the connector parts.

Figure 2:
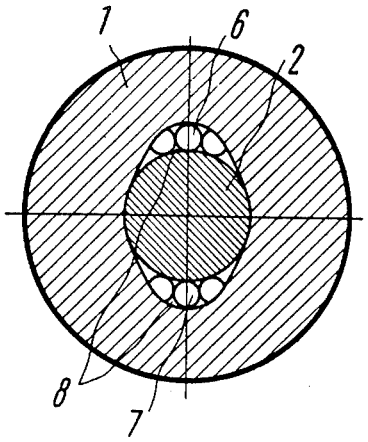
FIG. 2 is a cross sectional view taken along the line II—II in FIG. 1.

The connector of FIGS. 1 and 2 operates as follows. The ends of the conductor 6 and 7 to be jointed are bent to form a zigzag or dog-tooth pattern. The threaded interface surfaces 3 and 4 of the sleeve 1 and of the rod 2 and of the recesses 8 are degreased. The bent portions of the conductors 6 and 7 are laid in the recesses 8 so as to have the remaining portions of the conductors 6 and 7 extend in the direction of decreasing recess depth. The rod 2 and the sleeve 1 are then jointed together. At the time of the joining the threads of the rod 2 (or in FIGS. 3 and 4, of the sleeve 1) are pressed into the dog-toothed area of the conductors 6 and 7 to be jointed, accompanied by a shift in the contact surfaces relative to one another. The surface films are destroyed by plastic deformation to form cold weld joints.

Figure 4:
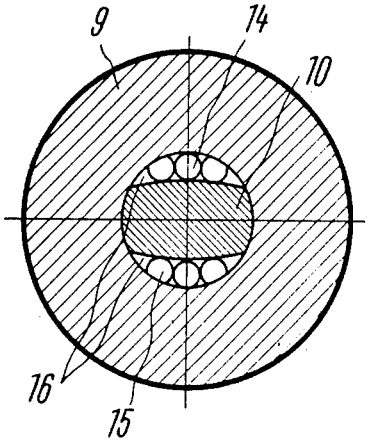
FIG. 4 is a cross sectional view taken along the line IV—IV in FIG. 3.

The foregoing also describes the operation of the connector illustrated in FIGS. 3 and 4. At least one of the connector parts to be connected must be made from a material having the least possible electrical resistance and not subject to recrystallization at room temperature. The welding can be accomplished with the use of other materials, too, except that in such case the rods must be made larger to secure a sufficiently low electrical resistance, the minimal electrical resistance preferably being the same as that of the conductors to be jointed.

The proposed connector for electric conductors offers the following advantages over old connectors of the same type:

lower electrical resistance, which under comparable conditions is decreased with increasing the number of wire bends;

simplified manufacture of the connector, it being possible—unlike with old connectors—to make use of conventional screw/nut workpieces;

improved mechanical strength of conductor connectors approximately equivalent to that of an unbroken conductor), there being no need with this connector to deform (overstress) the conductors to be jointed on account of the lower electrical resistance, such overstressing tending to reduce mechanical strength;

improved energy savings proportionate to the reduction in the electrical resistance, which is a particularly important consideration in jointing conductors carrying heavy currents;

conductors may be either dead-ended or line-jointed.

What is claimed is:

1. A connector for an electrical conductor, comprising two parts which are a threaded sleeve and a threaded rod, respectively, having interfacing threaded surfaces, and at least one longitudinally tapered recess for receiving the electrical conductor provided on the interfacing threaded surfaces of the rod, said recess having a surface extending inward at an acute angle to the longitudinal axis of the connector, with the depth of said recess increasing in one direction and decreasing in the opposite direction so that threading said parts together causes at least the threaded surfaces of the sleeve to engage and be pressed into the electrical conductor in the recess in the rod to form an electrical connection, and with the longitudinally tapered recess in the rod opening outward with respect to the rod along substantially the entire length of the recess.

* * * * *